US010022798B2

(12) United States Patent
Weiermair et al.

(10) Patent No.: US 10,022,798 B2
(45) Date of Patent: Jul. 17, 2018

(54) METHOD FOR FORMING A CROWNING ON A SINTERED COMPONENT

(71) Applicant: Miba Sinter Austria GmbH, Laakirchen (AT)

(72) Inventors: Alexander Weiermair, Eberstalzell (AT); Peter Hofmann, Pinsdorf (AT)

(73) Assignee: Miba Sinter Austria GmbH, Laakirchen (AT)

( * ) Notice: Subject to any disclaimer, the term of this patent is extended or adjusted under 35 U.S.C. 154(b) by 244 days.

(21) Appl. No.: 15/001,337

(22) Filed: Jan. 20, 2016

(65) Prior Publication Data

US 2016/0214178 A1 Jul. 28, 2016

(30) Foreign Application Priority Data

Jan. 23, 2015 (AT) ..... A 50042/2015

(51) Int. Cl.

| | |
|---|---|
| ***B22F 5/08*** | (2006.01) |
| ***B22F 3/03*** | (2006.01) |
| ***B30B 9/28*** | (2006.01) |
| ***B22F 3/16*** | (2006.01) |

(52) U.S. Cl.

CPC ..... *B22F 5/08* (2013.01); *B22F 3/03* (2013.01); *B22F 3/164* (2013.01); *B30B 9/28* (2013.01); *B22F 2003/166* (2013.01)

(58) Field of Classification Search

CPC ..... B22F 3/164; B22F 5/08; B22F 3/03; B21J 13/14; B30B 15/06; B30B 15/04; B30B 11/04; B30B 9/28

See application file for complete search history.

(56) References Cited

U.S. PATENT DOCUMENTS

| | | | |
|---|---|---|---|
| 3,584,488 | A | 6/1971 | Erdelyi |
| 4,111,031 | A | 9/1978 | Vennemeyer et al. |
| 4,414,729 | A | 11/1983 | Ridley |
| 6,168,754 | B1 | 1/2001 | Woolf et al. |
| 6,289,586 | B1 | 9/2001 | Casella et al. |
| 6,517,772 | B1 | 2/2003 | Woolf |

(Continued)

FOREIGN PATENT DOCUMENTS

| | | |
|---|---|---|
| AT | 508 990 B1 | 4/2012 |
| AT | 514 778 A1 | 3/2015 |

(Continued)

*Primary Examiner* — Peter DungBa Vo
*Assistant Examiner* — John S Lowe
(74) *Attorney, Agent, or Firm* — Collard & Roe, P.C.

(57) ABSTRACT

A method forms a crowning on a sintered component made from a sintering powder, in particular on the teeth of a sintered component including a toothing. The sintered component is calibrated in that the sintered component is introduced into a calibration tool. The sintered component includes a forming chamber with at least one forming wall. In the forming wall a crowning is formed which is inverse to the crowning of the sintered component to be formed. After calibration the sintered component is removed again from the calibration tool. The size of the forming chamber of the calibration tool remains unchanged at least for the time period beginning with the insertion of the sintered component into the calibration tool and ending after the removal of the sintered molding from the calibration tool.

8 Claims, 2 Drawing Sheets

(56) References Cited

U.S. PATENT DOCUMENTS

| | | | | |
|---|---|---|---|---|
| 8,783,080 | B2 | 7/2014 | Koller et al. | |
| 9,144,837 | B2 | 9/2015 | Roessler et al. | |
| 9,364,886 | B2 * | 6/2016 | Bonnefoy ..... | B21K 1/30 |
| 2005/0226759 | A1 | 10/2005 | Trasorras et al. | |

FOREIGN PATENT DOCUMENTS

| | | | |
|---|---|---|---|
| CH | 564 999 | A5 | 8/1975 |
| DE | 18 17 649 | A1 | 7/1970 |
| DE | 2 004 222 | A1 | 9/1970 |
| DE | 1 652 654 | A1 | 4/1971 |
| DE | 1 966 067 | A1 | 4/1971 |
| DE | 2 060 579 | A1 | 6/1972 |
| DE | 29 48 106 | A1 | 6/1981 |
| DE | 32 19 674 | A1 | 12/1982 |
| FR | 2 385 480 | A1 | 10/1978 |
| GB | 2 146 590 | A | 4/1985 |
| JP | 2008-049384 | A | 3/2008 |
| NO | 2008/116243 | A1 | 10/2008 |

* cited by examiner

METHOD FOR FORMING A CROWNING ON A SINTERED COMPONENT

CROSS REFERENCE TO RELATED APPLICATIONS

Applicant claims priority under 35 U.S.C. § 119 of Austrian Application No. A 50042/2015 filed on Jan. 23, 2015, the disclosure of which is incorporated by reference.

The invention relates to a method for forming a crowning on a sintered component made from a sintering powder, in particular on the teeth of a sintered component comprising a toothing, by calibrating the sintered component, for which reason the sintered component is inserted into a calibration tool which comprises a shaping chamber with at least one forming wall, wherein in the forming wall a crowning is formed which is inverse to the crowning of the sintered component to be formed and after calibration is removed again from the calibration tool.

A crowning on the teeth of components produced by power metallurgy is advantageous for the operating behavior of gears with a gear toothing, such as e.g. the contact pattern, NVH behavior, compensation of axis errors etc. The crowning can be formed by machining the toothing after sintering.

Rolling processes are also known from the prior art. Thus for example DE 32 19 674 A1 describes a method for forming a toothed rack-like tool for cold rolling a crowned toothing, according to which on a tool insert blank a toothing is formed with straight teeth, the tool insert blank being clamped during the production of the toothing and/or the tool insert provided with the toothing being curved during use such that on the finished tool, consisting of a tool support and the tool insert mounted thereon, a tooth shape of the toothing of the tooth insert is formed which is complementary to the tooth form of the crowned toothing.

Rolling processes for forming crownings are also known from DE 18 17 649 A1, DE 20 60 579 A1, AT 508 990 B1, WO 2008/116243 A1 and U.S. Pat. No. 6,517,772 B1.

Further methods and tools for producing crownings or for rolling gears are known from JP 2008-049384 A, DE 19 66 067 A1, DE 20 04 222 A1, DE 16 52 654 A1, FR 2 385 480 A1, GB 2 146 590 A, CH 564 999 A5, DE 29 48 106 A1 and U.S. Pat. No. 6,289,586 B1.

From the Austrian patent application of the Applicant with reference number A 50550/2013 a calibration tool is known for forming a crowning on a sintered component, in particular on the teeth of a sintered component comprising a toothing, comprising a calibration tool main body, in which a calibrating insert is mounted, wherein the calibrating insert comprises a recess for receiving the sintered component to be calibrated or for receiving a pressure pin. The calibrating insert can be adjusted in a direction perpendicular to the pressing direction, so that the diameter of the recess can be reduced or increased. In addition, an adjusting device is provided which acts on the calibrating insert to change the diameter of the recess. On an inner surface or an outer surface of the calibrating insert an depressed section or a raised section is formed for producing the crowning. Said patent application also describes a suitable method for forming a crowning on a sintered component by using said calibration tool.

The underlying objective of the present invention is to make it possible to form a toothing with teeth that have a crowning.

Said objective is achieved by the aforementioned method in which the size of the shaping chamber of the calibration tool is kept unchanged at least for the time period beginning with the insertion of the sintered component into the calibration tool and ending after the removal of the sintered molding from the calibration tool.

Surprisingly, it has been found that it is also possible to produce a crowning on a sintered component, in particular the teeth of a toothing of the sintered component, even if the calibrated sintered component is ejected from a calibrating mold after calibration, which does not make it possible to enlarge the latter for the ejection. The crowning therefore has to be forced on ejection by the provided cross-sectional tapering in the region of the axial opening of the calibration tool. It would be expected in this case that the crowning would become deformed and would disappear with the ejection of the sintered component. However, it has been established in tests that a certain degree of deformation may occur, but the crowning itself is retained to an extent which is sufficient for the sintered component from the point of view of its application. It is thus possible to simplify the formation of the crowning during the calibration of the sintered component, as no adjustments are necessary for decreasing or increasing the diameter of the forming chamber, as is the case in the aforementioned patent application of the Applicant with reference number A 50550/2013. In this way the processing time for a sintered component can also be reduced and thus the throughput increased per unit of time.

According to a preferred embodiment variant of the method a one-piece calibration tool made from rigid material is used. The calibration tool itself is thus easy to handle and is also designed to be more robust, so that greater shaping forces can be used during the calibration. By avoiding having a split calibration tool the formation of ridges on the sintered component can also be avoided more easily, whereby the method for forming the sintered components can also be shortened by reducing the individual process steps for the subsequent processing of the sintered component.

Preferably, it is also the case that the calibration for forming the crowning is performed directly after sintering the sintering powder. In particular, the sintered component is not surface compacted prior to the calibration. In this way it is possible for the calibration to be performed with less mechanical pressure on the sintered component, i.e. under "gentler" conditions. In addition, thus a reduction of the tolerances of the sintered component can also be achieved, as the plastic flow of material during calibration can be improved if the calibration is performed immediately after sintering the sintering powder.

According to another embodiment variant a calibration tool is used which comprises a cylindrical section connected directly to an insertion opening of the calibration tool for the sintered component. In this way it is possible to achieve a better crowning when ejecting the sintered component out of the calibration tool.

It is also possible for the calibrated surface of the sintered component to be surface compacted at least in some parts during the calibration and/or during the removal of the sintered component from the calibration tool, so that the sintered component has better mechanical characteristics even without subsequent surface compaction. By omitting the subsequent surface compaction the method for forming the sintered components can be shorted accordingly.

According to another embodiment variant of the method it is possible to use a calibration tool which has a shaping edge between the cylindrical section and the section with the crowning inverse to the crowning of the sintered component. In this way a sintered component can be produced which has a density gradient in the region of the surface in axial direction, whereby the contact pattern of a toothing in meshing engagement with another toothing can be improved.

A calibration tool can be used, the crowning, which is inverse to the crowning to be formed on the sintered component, being formed symmetrically in axial direction. In this way on the sintered component crownings can be formed which are asymmetrical in axial direction, whereby also the contact pattern of a toothing in meshing engagement with another toothing can be influenced.

However, it is also possible to use a calibration tool, the crowning, which is inverse to the crowning to be formed on the sintered component, being designed to be asymmetrical in axial direction. In this way the crowning of the sintered component in the calibration tool is also designed to be asymmetrical. This asymmetry can however be at least partly compensated for when ejecting the sintered component out of the calibration tool by a partial, plastic, permanent deformation, particularly if a shaping edge is formed in the calibration tool.

Preferably, in the latter embodiment variant of the method it is possible that a radius of curvature of the inverse crowning is greater in the direction of a first end face to a second end face of the calibration tool, whereby the formation of an at least almost symmetrical crowning on the sintered component is supported during the ejection of the calibrated sintered component.

For a better understanding of the invention the latter is explained in more detail with reference to the following Figures.

In a simplified, schematic representation:

Figure 1:
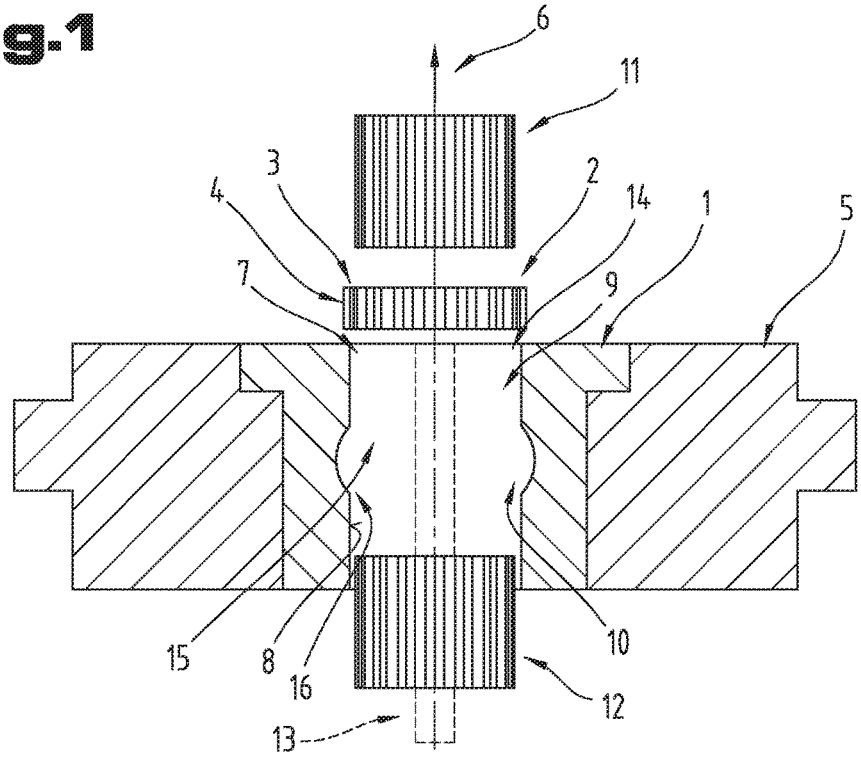
FIG. 1 is a first embodiment variant of a calibration tool in a cross-sectional side view.

First of all, it should be noted that in the variously described exemplary embodiments the same parts have been given the same reference numerals and the same component names, whereby the disclosures contained throughout the entire description can be applied to the same parts with the same reference numerals and same component names. Also details relating to position used in the description, such as e.g. top, bottom, side etc. relate to the currently described and represented figure and in case of a change in position should be adjusted to the new position.

FIG. 1 shows a calibration tool 1, which can also be denoted as a calibrating die, for calibrating a sintered component 2.

The sintered component 2 is in particular a spur gear. Within the meaning of the invention a spur gear is defined both as a spur gear itself (for meshing engagement with the toothing of a further gear) and also as a toothed belt wheel or sprocket. It is also possible however to form other sintered components 2 with the calibration tool 1.

For the sake of completion it should be noted that a sintered component 1 or a powder-metallurgical component is usually produced according to the following method steps:

- if necessary pre-alloying the powder used;
- mixing the powder;
- pressing a green compact from the powder in a mold;
- sintering the green compact, the sintering also being possible in two stages;
- calibrating the sintered component;
- if necessary mechanical and or physical post-processing (for example hardening) of the sintered component.

As said principle methods and variations thereof are known from the prior art, to avoid repetition reference is made to the relevant literature.

The calibration tool 1 is used in the method step "calibrating the component". In this method step not only is the calibration itself performed, i.e. to increase the dimensional precision of the sintered component 2, but at the same time a crowning is formed on the teeth 3 of a toothing 4 of the sintered component 2.

Figure 3:
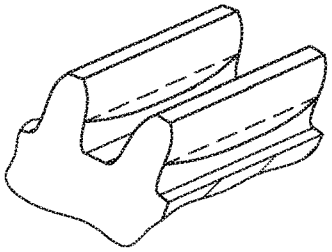
FIG. 3 is section of a toothing with a width crowning of the tooth flanks of the teeth.

In terms of the invention a crowning is defined in particular as a deviation from the linearity of the tooth flanks of the teeth of a gear wheel. This includes width crownings, as shown for example in FIG. 3, profile crowning and flank rotary crowning. Width crowning is in this case a modification of the tooth profile along the tooth width in axial direction of a gear wheel, longitudinal crowning is a modification of the theoretic tooth profiles in profile direction from tooth foot to tooth head and flank rotary crowning a modification of the tooth profile by rotating a tooth flank in longitudinal direction. The definitions of height and width crownings of toothings are given in standard DIN 3960.

In particular, a crowning is produced by means of the calibration tool 1.

All three kinds of crowning can be produced jointly or individually or in a combination of two of the aforementioned types of crowning.

Furthermore, the calibration tool 2 is preferably used on straight toothings. However, oblique toothings can also be produced with a crowning of the tooth profile.

The crowning can be designed to be both symmetrical and asymmetrical. This means that, for example, in a crowning one side of the tooth flanks (as viewed in axial direction of the gear wheel) can be set back further (relative to the theoretic profile) than the other side.

FIG. 1 shows a calibration tool 1 for the formation of a crowning on the tooth flanks of a tooth 3.

The calibration tool 1 can be held in a corresponding, not shown pressing device, in a tool holder 5. Both the tool holder 5 and the pressing device are known from the prior art and reference is made to the latter for further details.

Figure 2:
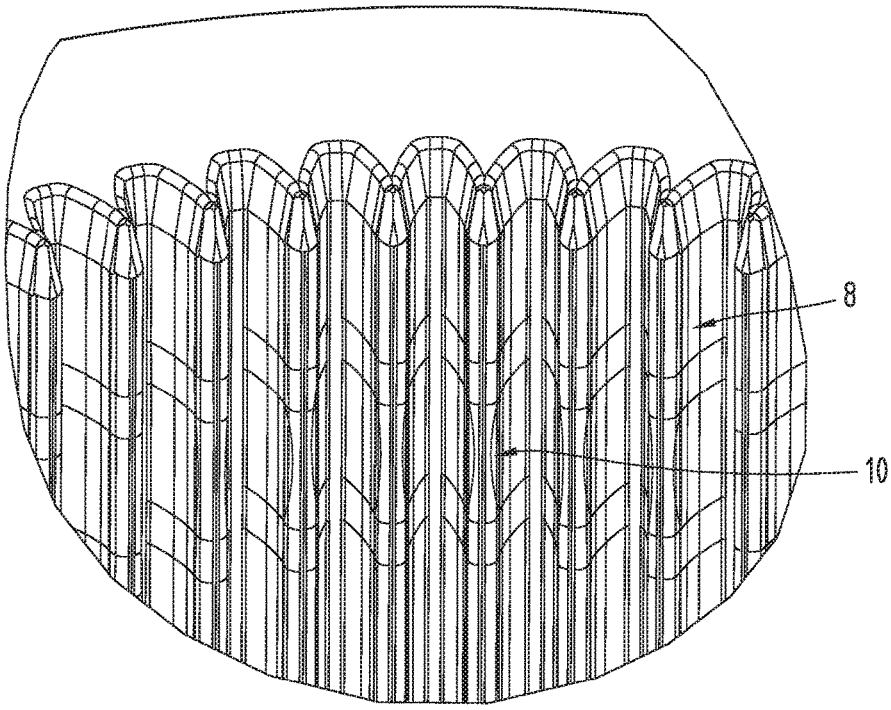
FIG. 2 is a section of the calibration tool in a view of the forming walls shaped in the form of a toothing.

The calibration tool 1 has a recess 7 designed to be continuous in an axial direction 6. The recess 7 is used for insertion into the calibration tool 1 and for the removal of the sintered component 1 out of the calibration tool 1. The recess 7 is surrounded by at least one forming wall 8. As shown better in FIG. 2 the forming wall 8 is designed in the form of a toothing in order to thus calibrate the toothing of the gear wheel.

Having at least one forming wall 8 means that the number of forming walls 8 is dependent on the form of the sintered component 2 to be calibrated.

The at least one forming wall 8 defines a forming chamber 9.

As already known the calibration of a sintered component is used for improving the dimensional precision of the sintered component, i.e. for example for correcting inaccuracies, such as e.g. warping, caused by the sintering. In this way tolerances can be reduced. Accordingly, the geometry of the forming chamber 9 and its dimensions generally correspond to the finished sintered component.

As by means of the calibration in the method that is the subject matter of this patent application, a crowning is formed on at least one surface of the sintered component 2, in the embodiment variant of the calibration tool 1 according to FIG. 1 a recess 10 is provided in the at least one forming wall 8 in the form of a depression. The form and the dimensions of said recess 10 correspond to the crowning to be produced in the calibration tool. The size of the recess 10 is preferably greater than the finished crowning on the sintered component 2 after demolding from the calibration tool 1. In this way it is possible to take into consideration a possibly permanent plastic deformation of the crowning on the sintered component 1 which may be caused by demolding.

The recess 10 is designed as a depression in this embodiment variant of the calibration tool 1. Thus by means of said calibration tool 1 a positive crowning is formed, in particular a positive crowning, on the tooth flanks of the sintered component 2.

For the production of gear wheels the recess 10 is designed to be axially symmetrical. However, if the sintered component 2 to be calibrated differs from the "circle geometry", the basic outline of the recess 10 is adjusted accordingly in axial direction 11 to the basic outline of the sintered component 2, i.e. the contour in radial direction, in order to place the sintered component 2 fully over its circumference on the forming wall 8.

If a gear wheel is calibrated by the calibration tool 1 the inner surface of the calibration tool 1 also has a toothing.

For the production of the sintered component 1, as already explained above, from a sintering powder a semi-finished sintered component 1 is produced by sintering. In this state the sintered component 1 still does not have any crowning on at least one of its surfaces, i.e. in particular no crowning of the tooth flanks of the teeth 3 of a toothing of a gearwheel. The crowning is only formed during the calibration of the sintered component 1.

It should be mentioned in this connection that the cross section of a normal involute toothing in itself, which can occur after sintering, is not defined as a crowning within the meaning of the invention.

The calibration of the sintered component 1 is performed by means of an upper punch 11 and a lower punch 12. Both the upper punch 11 and the lower punch 12 are adjusted on their radial outer surfaces to the geometry of the at least one forming wall 8, and can thus for example also have an outer toothing which engages in the inner toothing of the calibration tool 1 during the calibration.

For calibrating the sintered, preferably not surface-compacted sintered component 2, the latter can be placed on the lower punch 12, for which reason the lower punch 12 can be moved in axial direction 6 upwards to the upper opening of the calibration tool 1. As soon as the toothing of the sintered component 2 coincides in its position with the inner toothing of the calibration tool 1, if the sintered component 2 comprises a toothing, the upper punch 11 is lowered downwards in the direction of the lower punch 12 until it lies on the sintered component 2. In this position then the lower punch 12 and the upper punch 11 are lowered downwards further so that the sintered component 2 enters the area of the recess 10 of the calibration tool. For the calibration afterwards the upper punch 11 can be lowered even further in the direction of the stationary lower punch. This causes a material flow, in that the recess 10 for forming the crowning of the calibration tool 1 is filled with the displaced material. In addition, also other inaccuracies of the sintered component are corrected, as already known. The sintered component 2 is thus applied fully onto the calibration tool 2 and reproduces the inner contour of the forming chamber 9.

As soon as said calibration step has been completed, the upper punch 11 is lifted again so that the latter is disengaged from the calibration tool. Afterwards the calibrated sintered component is ejected from the calibration tool 1 by lifting the lower punch 12. As the cross section of the forming chamber 9 becomes smaller towards the top, the sintered component 2 is partly deformed back plastically. Surprisingly, however the formed crowning, in particular width crowning, is retained, so that the finally calibrated, ejected sintered component 2 has the desired crowning permanently after ejection.

Thus by means of the invention a method is provided for forming a crowning on a sintered component 2 made from a sintering powder, in particular on the teeth of a sintered component 2 comprising a toothing, by calibrating the sintered component 2, for which reason the sintered component 2 is introduced into the calibration tool 1, which comprises the forming chamber 9 with at least one forming wall 8, wherein in the forming wall 8 a complementary crowning is formed which is inverse to the crowning of the sintered component 2 to be produced, and after the calibration is removed again from the calibration tool. The size of the forming chamber 9 of the calibration tool 1 remains unchanged at least for the time period beginning with the insertion of the sintered component 2 into the calibration tool and ending after the removal of the sintered molding 2 from the calibration tool 1. This means that the diameter or the cross-sectional shape is not changed at any point in the calibration tool 1 at least during said time period, i.e. is not increased or reduced, as is the case in the method according to the aforementioned patent application of the Applicant with reference number A 50550/2013. Preferably, the calibration tool is made from a solid material and is in particular designed in one piece, i.e. is not separable.

The possibility of the permanent plastic deformation of the crowning during the removal of the sintered component 2 from the calibration tool can if necessary be taken into account simply by a suitable configuration of the size of the forming chamber 9, so that the finally calibrated sintered component 2 always has the desired amount degree of crowning.

The demolding of the sintered component 2 can also be performed so that firstly the lower punch 12 is lowered and then the sintered component is ejected downwards 2 by the upper punch 11.

For centering the sintered component 2 a core pin 13 can be provided, as indicated by a dashed line in FIG. 1, which can be arranged to be stationary in the calibration tool 2, i.e. fixed.

The calibration tool 1 preferably consists of a one-piece, rigid, in particular metallic material, so that the method can be performed by using such a calibration tool 1. In particular the calibration tool 1 can be made from a steel.

It is also preferable, if the calibration for forming the crowning is performed immediately after sintering the sintering powder.

Although it is possible in principle that the recessed section in the at least one forming wall 8 of the calibration tool 1 is formed immediately adjoining an insertion opening 14 of the calibration tool 1 for the insertion of the sintered component 2, it is preferable if the calibration tool 1 at the insertion opening 14 immediately adjoining firstly at least one cylindrical section 15 has a constant diameter, to which the depression in the forming wall 8, i.e. the recess 10, connects for the formation of the crowning, as shown in FIG. 1.

It is also possible, although not preferred, that the section 15 is designed to be conical.

Preferably, the calibration tool also comprises a second cylindrical section, which is formed at the bottom in the area of the dipping lower punch 12, as shown in FIG. 1.

The negative crowning in the calibration tool 1, i.e. the recess 10 can be formed for example by deflection during erosion with a defined factor. The maximum depth of the recess 10 relative to the cylindrical inner surface of the calibration tool conforms to the desired geometry of the crowning to be formed on the sintered component 2. For example a radius of curvature 16 of the depressed section of the recess 10 designed with a curvature can be selected from a range of 10 mm to 15,000 mm.

Figure 4:
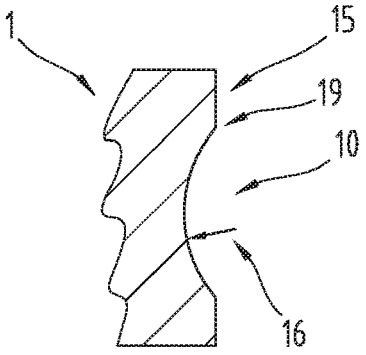
FIG. 4 is a detail of another embodiment variant of a calibration tool in a cross-sectional side view.

As shown in FIG. 4, the recess 10 of the calibration tool 1 can be designed to be symmetrical, so that the curvature of the negative crowning has only one constant radius of curvature 16.

Figure 5:
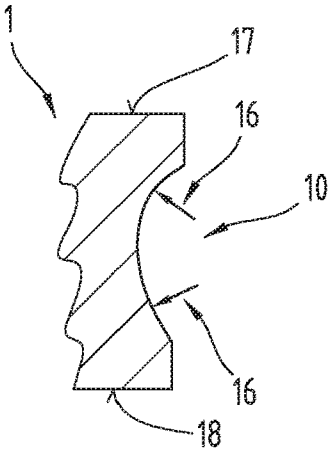
FIG. 5 is a detail of a further embodiment variant of a calibration tool in a cross-sectional side view.

However, it is also possible, as shown in FIG. 5, for the calibration tool 1 to have a crowning in axial direction, which is inverse to the crowning to be formed on the sintered component 2, which is designed to be asymmetrical. The recess 10 of the calibration tool 1 can be designed for example to have different radii of curvature 16. Thus the radius of curvature 16 of the recess 10 can become greater in the direction from a first end face 17 to a second end face 18 of the calibration tool 1.

It is also possible for the calibrated surface of the sintered component 2 to be surface compacted at least in some sections during the calibration and/or during the removal of the sintered component 2 from the calibration tool 1. For this the recess 7 (FIG. 1) of the calibration tool 1 can be designed to have a smaller diameter than the maximum external diameter of the sintered component 2.

In addition, it is also possible that a calibration tool 1 is used in the method which has a shaping edge 19. This can be formed for example, as shown in FIG. 4, in the transitional area from the recess 10 to the cylindrical section 15 of the calibration tool 1. For example, said transitional area can be designed to have sharp edge. In this way a density gradient of the calibrated surface can be formed in axial direction 6.

Figure 6:
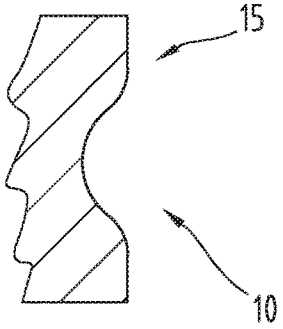
FIG. 6 is a detail of a further embodiment variant of a calibration tool in cross-sectional side view.

However, it should be noted that the transition from the recess 10 to the cylindrical section 15 is provided with a curvature, as shown in FIG. 6.

Figure 7:
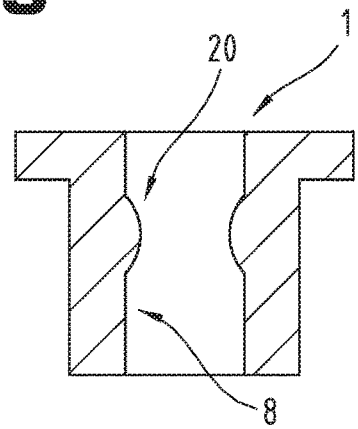
FIG. 7 is a detail of another embodiment variant of a calibration tool in a cross-sectional side view.

FIG. 7 shows an embodiment variant of the calibration tool 1, which instead of the recess 10 in the at least one forming wall 8 comprises an elevation 20, which projects radially inwards over the forming wall 8. It is thus possible to produce sintered components 2 which have a negative crowning, as an inwards shaping, for example in the region of the tooth flanks.

In general, the crowning, depending on the design of the calibration tool 1, can also be provided on the tooth head of a gear wheel or toothed sintered component 1.

It is also possible for the calibration of the sintered component 2 to be performed hot, whereby the formation of the crowning is simplified.

Although the above explanations relate to the outer surfaces of sintered components 2, in particular to the outer toothings of sintered components 2, it is possible to provide internal toothings or inner surfaces of sintered components 2 with such crownings. For this a core pin is used with a suitably shaped surface, i.e. with a surface comprising a crowning. Said core pin does not need to be fixed however, as with the aforementioned core pin 13. It is thus possible that said core pin can move up and down in axial direction 6.

The calibrated sintered component 2 formed according to the method and provided with a crowning is preferably not surface compacted after calibration. Also preferably no hard/fine processing of the calibrated surface is performed. However, various different heat treatments can be applied after calibration, as known in the field of producing sintered components 2.

The example embodiments show possible embodiment variants of the calibration tool 1, whereby it should be noted at this point that various different combinations of the individual embodiment variants are also possible.

Finally, as a point of formality, it should be noted that for a better understanding of the structure of the calibration tool 1 the latter or its components have not been represented true to scale in part and/or have been enlarged and/or reduced in size.

LIST OF REFERENCE NUMERALS

1 calibration tool
2 sintered component
3 tooth
4 toothing
5 tool holder
6 axial direction
7 recess
8 forming wall
9 forming chamber
10 recess
11 upper punch
12 lower punch
13 core pin
14 insertion opening
15 section
16 radius of curvature
17 end face
18 end face
19 shaping edge
20 elevation

The invention claimed is:

1. A method for forming a crowning on at least one surface of a sintered component made from a sintering powder, the sintered component comprising a toothing with the crowning formed on the teeth of the toothing of the sintered component, the method comprising:

calibrating the sintered component, wherein the sintered component is introduced into a recess of a calibration tool which comprises a forming chamber defined by at least one forming wall, wherein in the forming wall a crowning is formed which is inverse to the crowning of the sintered component to be formed by molding in the forming chamber and thereafter removing the sintered component having the crowning formed on the teeth of the toothing from the calibration tool through ejection by a punch, wherein the size of the forming chamber of the calibration tool remains unchanged at least for the time period beginning with the insertion of the sintered component into the calibration tool and ending after the removal of the sintered component from the calibration tool through ejection by the punch, and wherein said calibration tool is made from a one-piece rigid metallic material.

2. The method as claimed in claim 1, wherein the calibration for forming the crowning is performed immediately after the sintering of the sintering powder.

3. The method as claimed in claim 1, wherein a calibration tool is used which comprises a cylindrical section which connects directly to an insertion opening of the calibration tool for the sintered component.

4. The method as claimed in claim 1, wherein the calibrated surface of the sintered component is compacted on the surface at least partly during the calibration and/or during the removal of the sintered component from the calibration tool.

5. The method as claimed in claim 3, wherein a calibration tool is used which has a shaping edge between the cylindrical section and the section with the crowning which is inverse to the crowning of the sintered component.

6. The method as claimed in claim 1, wherein a calibration tool is used, the crowning of which being inverse to the crowning to be formed on the sintered component is designed to be symmetrical in an axial direction.

7. The method as claimed in claim 1, wherein a calibration tool is used, the crowning of which being inverse to the crowning to be formed on the sintered component is designed to be asymmetrical in an axial direction.

8. A method for forming a crowning on at least one surface of a sintered component made from a sintering powder, the sintered component comprising a toothing with the crowning formed on the teeth of the toothing of the sintered component, the method comprising:

calibrating the sintered component, wherein the sintered component is introduced into a recess of a calibration tool which comprises a forming chamber defined by at least one forming wall, wherein in the forming wall a crowning is formed which is inverse to the crowning of the sintered component to be formed by molding in the forming chamber, and thereafter removing the sintered component having the crowning formed on the teeth of the toothing from the calibration tool through ejection by a punch, wherein the size of the forming chamber of the calibration tool remains unchanged at least for the time period beginning with the insertion of the sintered component into the calibration tool and ending after the removal of the sintered component from the calibration tool through ejection by the punch, wherein the crowing of said calibration tool being inverse to the crowning to be formed on the sintered component is asymmetrical in an axial direction and wherein a radius of curvature of the inverse crowning becomes greater in the direction from a first end face to a second end face of the calibration tool, and wherein said calibration tool is made from a one-piece rigid metallic material.

* * * * *